United States Patent [19]

Baumgartner et al.

[11] Patent Number: 4,822,260

[45] Date of Patent: Apr. 18, 1989

[54] DEVICE FOR CONTROLLING FLUID SUPPLY TO A ROTARY PISTON MACHINE

[75] Inventors: Hans Baumgartner, Viersen; Ulrich Henke, Übach-Palenberg; Manfred Brandstädter, Düsseldorf; Klaus Heikrodt; Herbert Schneider, both of Krefeld, all of Fed. Rep. of Germany

[73] Assignee: Pierburg GmbH, Fed. Rep. of Germany

[21] Appl. No.: 97,941

[22] Filed: Sep. 17, 1987

[30] Foreign Application Priority Data

Sep. 17, 1986 [DE] Fed. Rep. of Germany ..... 3631574
Feb. 12, 1987 [DE] Fed. Rep. of Germany ..... 3704336

[51] Int. Cl.[4] ..... F04B 49/00; F04C 2/04
[52] U.S. Cl. ..... 417/440; 418/15
[58] Field of Search ..... 418/15, 159, 270, 168; 417/503, 440

[56] References Cited

U.S. PATENT DOCUMENTS

| | | | |
|---|---|---|---|
| 3,120,814 | 2/1964 | Mueller | 417/310 |
| 3,327,636 | 6/1967 | Purcell | 418/168 |
| 4,028,023 | 7/1977 | Labos | 418/168 |
| 4,723,895 | 2/1988 | Hayase | 417/503 |

FOREIGN PATENT DOCUMENTS

| | | | |
|---|---|---|---|
| 395420 | 10/1921 | Fed. Rep. of Germany | 418/270 |
| 415473 | 4/1922 | Fed. Rep. of Germany | 418/270 |
| 1024196 | 2/1958 | Fed. Rep. of Germany . | |
| 1043817 | 11/1958 | Fed. Rep. of Germany | 418/15 |
| 3432915 | 12/1985 | Fed. Rep. of Germany . | |
| 3528502 | 2/1987 | Fed. Rep. of Germany . | |
| 319899 | 8/1934 | Italy | 418/15 |
| 609055 | 9/1960 | Italy | 418/15 |
| 203803 | 11/1984 | Japan | 418/15 |
| 133890 | 9/1929 | Switzerland | 418/15 |
| 760864 | 11/1956 | United Kingdom | 418/15 |
| 839149 | 6/1960 | United Kingdom . | |
| 1404328 | 8/1975 | United Kingdom . | |
| 2065230 | 6/1981 | United Kingdom . | |
| 2158881 | 11/1985 | United Kingdom | 418/159 |

*Primary Examiner*—William L. Freeh
*Attorney, Agent, or Firm*—Roberts, Spiecens & Cohen

[57] ABSTRACT

A device for controlling a rotating-piston machine in which inner and outer rotors rotate at unequal speeds and profiled teeth thereon form gaps to define working chambers which move, with change of volume, from an inlet region to an outlet region of the machine. The device comprises a body having a feed channel for a working fluid, a plurality of supply channels which open into the inlet region and two rotary slide valves for controlling communication between the feed channel and the supply channels to fill the working chambers during development of suction therein upon rotation of the rotors. The body has two round cutouts each containing a respective rotary slide valve. One slide valve controls supply of fluid at the beginning of development of suction in each working chamber whereas the other slide valve controls supply fluid at the end of development of suction in each working chamber. Each cut-out is connected to the feed channel and to respective associated pluralities of supply channels.

10 Claims, 2 Drawing Sheets

DEVICE FOR CONTROLLING FLUID SUPPLY TO A ROTARY PISTON MACHINE

FIELD OF THE INVENTION

The present invention relates to a device for controlling fluid supply to a rotary piston machine and particularly to such a machine having inner and outer rotors rotating at unequal speeds of rotation and provided with profiled teeth which form gaps to define working chambers which move with change of volume, from an inlet region to an outlet region and wherein the filling of the working chambers with fluid and expansion of the fluid in the working chambers from the beginning to the end of a variable suction action in the working chambers is controlled by two rotary slide valves which control the communication between a plurality of supply channels in the inlet region with a feed channel for the fluid.

DESCRIPTION OF PRIOR ART

A device for controlling a rotary piston machine of the above type is described in DE-OS No. 35 28 502 in which a plurality of channels are arranged in the inlet region which can be opened one after the other in the direction of rotation and in part closed again so as to obtain an expansion with recovery of power.

For the control of the fluid supply, it is contemplated to arrange within a round cutout two rotary slide valve shells which are movable independently of one another so that the channels to be opened and the channels to be closed can be controlled independently of each other.

In this regard, the round cutout which receives the rotary slide valve shells must be of a substantial diameter, which results, on the one hand, in long supply channels, which produce large throttling losses, and in a large structural size for the machine.

Means for achieving fluid expansion are known from DE-AS 10 24 196 in which a cylinder wall is displaceable as a control slide valve, and from DE-OS No. 34 32 915, for displacement of a segment of the cylinder wall.

These features, however, cannot be adapted to the machines of the invention and are technically expensive.

DE-OS No. 35 01 782 describes a rotating vane compressor having an inlet which is formed by bore holes which can be controls by a slide valve. The same problem is thus present as in DE-OS No. 35 28 502 which is the forerunner of this type, namely long channels and large size.

SUMMARY OF THE INVENTION

An object of the present invention is to provide a control device for a rotary piston machine by which the length of the channels at the inlet region and thus the size of the machine itself are reduced while a sensitive control is obtained.

The above and further objects of the invention are achieved by providing two round cutouts with resepective rotary slide valves therein, one slide valve controlling supply of fluid at the beginning of development of suction in each working chamber in the rotary piston machine, the other slide valve controlling supply of fluid at the end of development of suction in each working chamber, each cutout being connected to a feed channel for the working fluid and to a respective associated plurality of slide channels, the rotary slide valves being driven together in coupled relation.

In accordance with a particular embodiment, the supply channels extend generally parallel to one another and the feed channels open into the cutouts substantially parallel to the supply channels.

According to another feature of the invention, each of the rotary slide valves comprises two shell segments which are slideably engaged for relative angular movement between overlapping and extended positions and which provide lost motion between the segments.

By virtue of the construction according to the invention, the rotary piston machine is of small structural size and has shorter channel lengths to provide low loss while sensitive control is assured by a suitable coupling of the rotary slide valves.

By forming the rotary slide valves as shelled segments, blockage of the feed channels and the supply channels by the rotary slide valves is prevented.

BRIEF DESCRIPTION OF THE FIGURES OF THE DRAWING

Illustrative embodiments of the invention are described below with reference to the drawing, in which.

DETAILED DESCRIPTION OF PREFERRED EMBODIMENT

Figure 1:
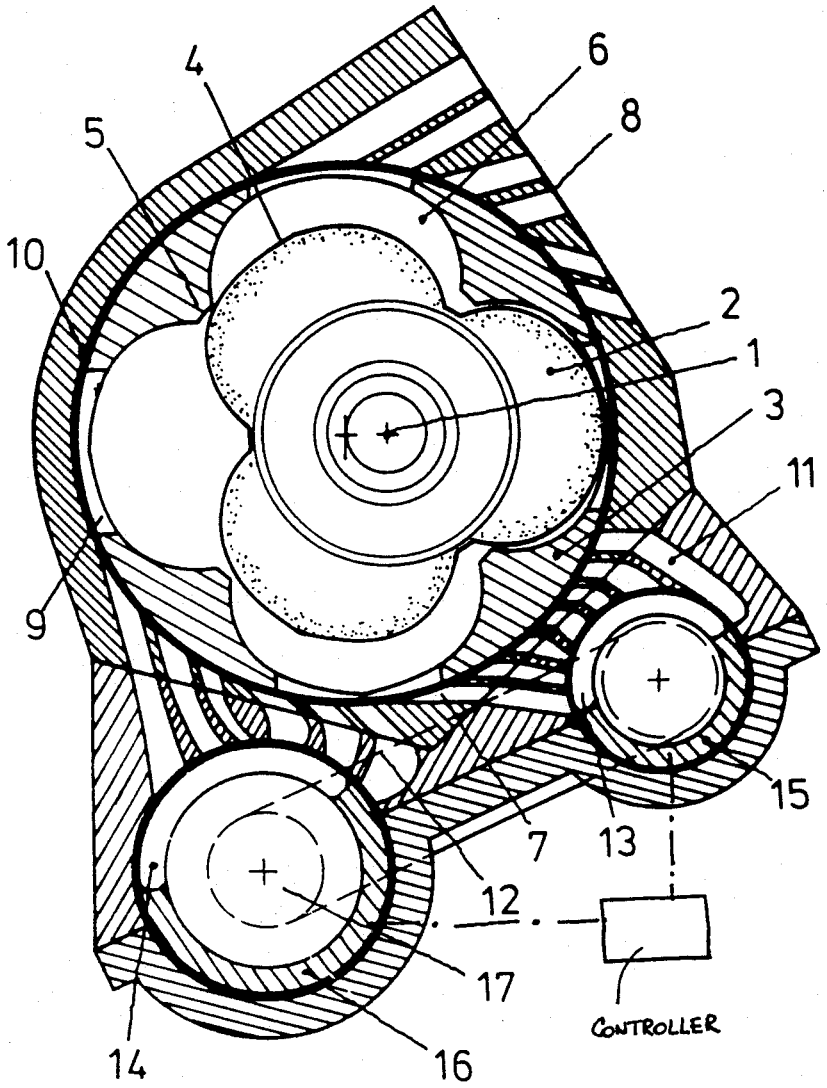
FIG. 1 is a diagrammatic sectional view of a rotary piston machine according to one embodiment of the invention.

FIG. 1 shows, in cross section, a rotary piston machine having an inner rotor 2 secured for rotation on a rotor shaft 1 and an outer rotor 3 which is mounted for rotation about an axis 1 for rotation eccentrically relative to the inner rotor. The rotors 2 and 3 have profiled teeth 4, 5 which are in mesh engagement and form working chambers in tooth gaps 6 present between the profiled teeth 5. The working chambers move while changing in volume upon rotation of the inner and outer rotors 2, 3 from an inlet region 7 of the machine to an outlet region 8 of the machine. The speeds of rotation of the inner and outer rotors 2, 3 are in the reverse ratio of their number of teeth, i.e. the inner rotor 2 turns four times while the outer rotor 3 turns three times. In order to avoid friction between the flanks of the profiled teeth, the rotors 2, 3 are coupled to each other by a pair of gears (not shown). The outer rotor 3 has radial openings 9 which permit entry at inlet region 7 of the fluid to be conveyed and its discharge when the openings 9 pass into the outlet region 8. Between the inlet region 7 and the outlet region 8, the outer rotor 3 travels in a solid portion of the housing bore 10 which closes openings 9.

The inlet region 7 is formed by a plurality of channels 11, 12 which open radially into bore 10 one after the other in the direction of rotation of the rotor 3. The plurality of channels 11 are grouped to supply fluid at the start of filling of the chambers and the plurality of channels 12 supply the fluid at the end of the filling cycle. The channels 11 and 12 open substantially radially into respective round cutouts 13, 14 in which are arranged rotary slide valves 15, 16 which are coupled by rods, gears or separate setting members to a controller which can be operated according to programmed data. The coupling of the rotary slide valves to the controller is diagrammatically illustrated in FIG. 1 by chain-dotted lines. The cutouts 13, 14 are supplied with the fluid being conveyed through a feed channel 17. By virtue of the coupling of the rotary slide valves 15, 16, it is possible to obtain a sensitive control of the fluid volume being conveyed and at the same time an adaptation of the expansion of the fluid to the outlet pressure, i.e. rotary slide valve 16 controls the filling of the working chambers and rotary slide valve 15 controls the expansion of the fluid transferred from the delivery to the suction side. The rotating piston machine is adapted to operate by power development during expansion with good efficiency and the machine is of reduced size as compared with known machines.

The rods, gears or separate setting members can customarily be actuated electrically, pneumatically or hydraulically.

Figure 2:
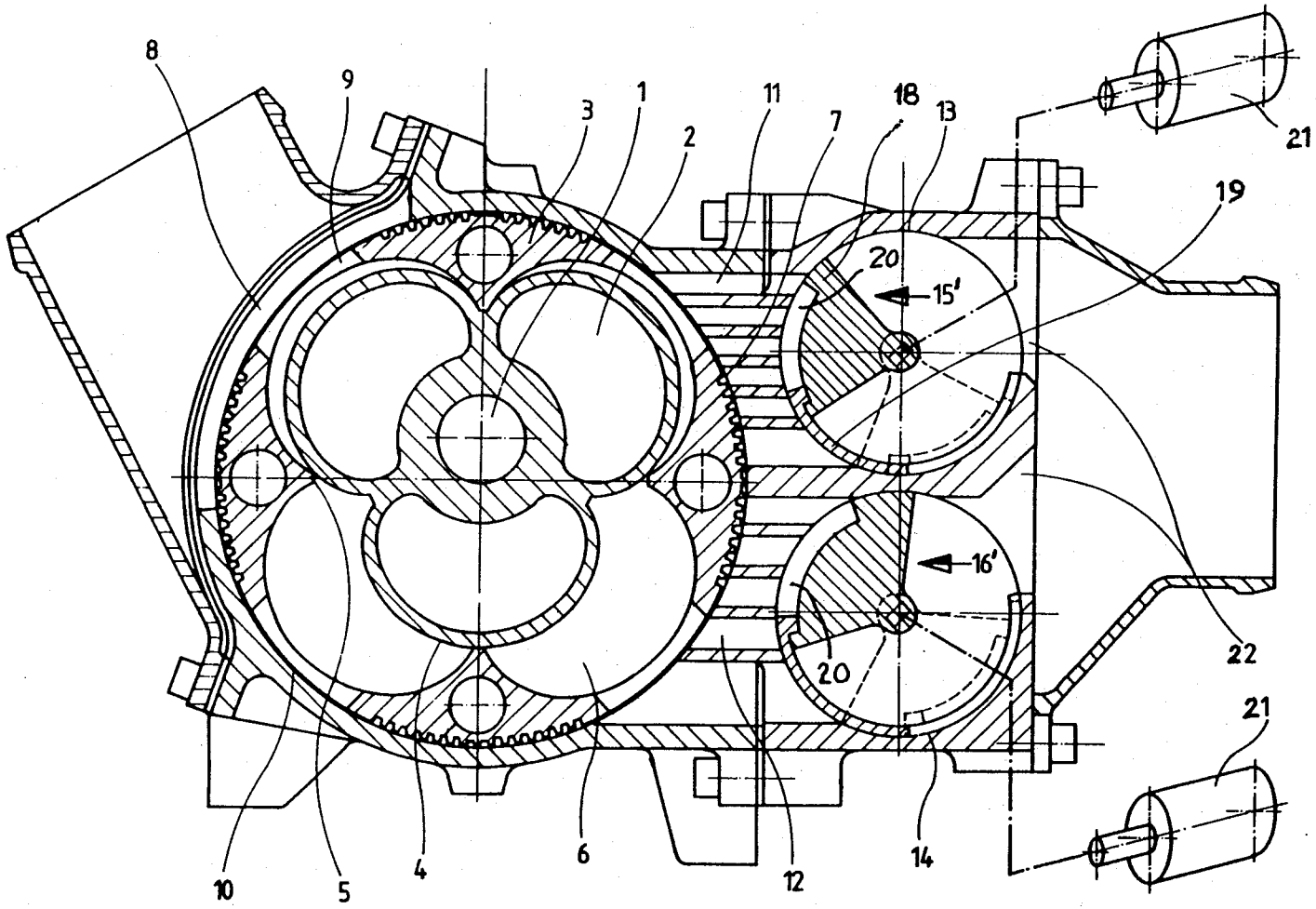
FIG. 2 is an illustration of a second embodiment of the invention.

FIG. 2 shows another embodiment in which rotary slide valves 15[1], 16[1] are formed by two shell segments 18, 19 which are slidably engaged for relative angular movement between overlapping and extended positions. The ends of the shell segments are angularly spaced at slots 20 to permit lost angular motion between the segments. During an opening operation from the state shown in FIG. 2, shell segment 18 first moves with lost motion into overlapped registers above the other segment 19 whereafter the segments are jointly moved further. The opening movement is effected by electrically controlled stepping motors 21, each connected to a respective shell segment 18 which is the first to open, and the further shell segment 19 being carried along by the first shell 18 when the lost motion provided by slot 20 is taken up.

Upon the complete opening of all of the channels 11 by both segment shells 17, 18 of the cutout 13, the opening movement of the segment shells 17, 18 of the cutout 14 takes place in the same manner.

In FIG. 2, the feed channels 22 extend substantially parallel to channels 11, 12 and open into the cutouts 13, 14 substantially radially.

In operation, as an opening 9 passes over the first group of channels 11, the rotary slide valve 15 or 15[1] establishes corresponding communication between the feed channel 17 or 22 and the channels 11 so that fluid is progressively supplied to the working chamber to control filling of the working chamber. As the opening 9 continues to rotate, it begins to communicate with the second group of channels 12 whose communication with the feed channel is controlled by the rotary slide valve 16 or 16[1] to effect controlled filling of the working chamber.

Although the invention has been described in relation to specific embodiments thereof, it will become apparent to those skilled in the art that numerous modifications and variations can be made without departing from the scope and spirit thereof as defined in the attached claims.

What is claimed is:

1. A device for controlling a rotating-piston machine having inner and outer rotors rotating at unequal speeds of rotation and provided with profiled teeth which form gaps to define working chambers which move, with change of volume, from an inlet region to an outlet region, said device comprising a body having a feed channel for a working fluid, a plurality of supply channels which open into said inlet region and two rotary slide valve means for controlling communications between the feed channel and the supply channels to fill the working chambers during development of suction therein upon rotation of said rotors, said body having two round cutouts, said two rotary slide valve means comprising respective rotary slide valves each in a respective one of said cutouts, said supply channels being arranged in two groups one for each rotary slide valve so that one slide valve controls supply of fluid at the beginning of development of suction in each working chamber while the other slide valve controls supply of fluid at the end of development of suction in each working chamber, each cutout being connected to said feed channel, and to respective associated pluralities of supply channels and means coupled to said slide valves for rotating the same to control supply of fluid to the supply channels in the respective two groups and thereby control the respective supply of fluid at the beginning and end of suction development in each working chamber.

2. A device as claimed in claim 1 wherein said rotary slide valves are coupled together for common drive.

3. A device as claimed in claim 1 wherein said supply channels extend substantially radially from said cutouts.

4. A device as claimed in claim 1 wherein said means for driving said rotary slide valves comprises a drive motor connected to each rotary valve.

5. A device as claimed in claim 1 wherein said means for rotating said rotary slide valves comprises means coupling the slide valves for common rotation, and controller means for operating the slide valves in rotation.

6. A device as claimed in claim 1 wherein said channels extend substantially parallel to one another.

7. A device as claimed in claim 6 wherein said feed channel includes two branches each respectively opening into one of said cutouts, said branches extending substantially parallel to said supply channels.

8. A device as claimed in claim 7 wherein each slide valve comprises two shell segments slideably engaged for relative angular movement between overlapping and extended positives.

9. A device as claimed in claim 8 wherein said shell segments have enterengaged ends which cause the shell segments to move together in one direction of rotation in extended positions and to move the opposite direction of rotation in overlapped position.

10. A device as claimed in claim 7 wherein said ends of said shell segments are spaced angularly to provide lost motion between the segments.

* * * * *